US010392223B2

(12) United States Patent
Simcik et al.

(10) Patent No.: US 10,392,223 B2
(45) Date of Patent: Aug. 27, 2019

(54) SERVICE REQUEST USING WIRELESS PROGRAMMABLE DEVICE

(71) Applicant: Otis Elevator Company, Farmington, CT (US)

(72) Inventors: Paul A. Simcik, Southington, CT (US); Luis C. Encinas Carreno, Farmington, CT (US); Eric C. Peterson, East Longmeadow, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 547 days.

(21) Appl. No.: 15/101,521

(22) PCT Filed: Dec. 6, 2013

(86) PCT No.: PCT/US2013/073586
§ 371 (c)(1),
(2) Date: Jun. 3, 2016

(87) PCT Pub. No.: WO2015/084396
PCT Pub. Date: Jun. 11, 2015

(65) Prior Publication Data

US 2016/0355375 A1 Dec. 8, 2016

(51) Int. Cl.
*B66B 1/16* (2006.01)
*B66B 1/46* (2006.01)
(Continued)

(52) U.S. Cl.
CPC ..... *B66B 1/468* (2013.01); *B66B 1/3461* (2013.01); *B66B 25/00* (2013.01);
(Continued)

(58) Field of Classification Search
CPC ..... B66B 1/468; B66B 1/3461; B66B 25/00; B66B 2201/4615; B66B 2201/4653; B66B 2201/4661; B66B 2201/4676
(Continued)

(56) References Cited

U.S. PATENT DOCUMENTS 6,109,396 A * 8/2000 Sirag ..... B66B 1/468 187/381
6,202,799 B1 * 3/2001 Drop ..... B66B 1/468 187/384
(Continued)

FOREIGN PATENT DOCUMENTS

JP 2002114456 A 4/2002
JP 2003212446 A 7/2003
(Continued)

OTHER PUBLICATIONS

European Search Report for application EP13898838, dated Jun. 2, 2017, 8pgs.
(Continued)

*Primary Examiner* — Anthony J Salata
(74) *Attorney, Agent, or Firm* — Cantor Colburn LLP

(57) ABSTRACT

A method includes receiving, by a computing device comprising a processor, a request for at least one service associated with an elevator system from a mobile device over a cellular network. The request is validated based on a determined location of the mobile device. In response to the validating indicating that the request is approved, at least one resource associated with the at least one service is scheduled. The scheduling of the at least one resource includes placement of an elevator car call.

15 Claims, 3 Drawing Sheets

(51) Int. Cl.
*B66B 1/34* (2006.01)
*B66B 25/00* (2006.01)

(52) U.S. Cl.
CPC ..... *B66B 2201/4615* (2013.01); *B66B 2201/4653* (2013.01); *B66B 2201/4661* (2013.01); *B66B 2201/4676* (2013.01)

(58) Field of Classification Search
USPC ..... 187/247, 380–388, 391, 392, 393
See application file for complete search history.

(56) References Cited

U.S. PATENT DOCUMENTS

| | | | | |
|---|---|---|---|---|
| 6,354,405 | B1 * | 3/2002 | Svensson-Hilford | B66B 1/468 187/384 |
| 6,382,363 | B1 * | 5/2002 | Friedli | B66B 1/468 187/384 |
| 6,397,976 | B1 * | 6/2002 | Hale | B66B 1/468 187/384 |
| 6,868,945 | B2 * | 3/2005 | Schuster | B66B 1/468 187/380 |
| 7,162,233 | B2 | 1/2007 | Chiba | |
| 7,353,915 | B2 * | 4/2008 | Zaharia | B66B 1/468 187/388 |
| 7,552,800 | B2 * | 6/2009 | Puskala | B66B 1/468 187/384 |
| 7,823,700 | B2 * | 11/2010 | Boss | B66B 1/468 187/247 |
| 8,061,485 | B2 * | 11/2011 | Finschi | B66B 1/468 187/384 |
| 8,136,636 | B2 | 3/2012 | Bahjat et al. | |
| 8,573,366 | B2 * | 11/2013 | Elomaa | B66B 1/2458 187/387 |
| 8,813,917 | B2 * | 8/2014 | Salmikuukka | B66B 1/468 187/247 |
| 8,880,200 | B2 * | 11/2014 | Nowel | B66B 1/468 187/247 |
| 8,960,373 | B2 * | 2/2015 | De Vincentis | B66B 1/468 |
| 9,284,158 | B2 * | 3/2016 | Sarjanen | B66B 1/468 |
| 9,323,232 | B2 * | 4/2016 | Blom | H04W 4/029 |
| 9,580,272 | B2 * | 2/2017 | Kappeler | B66B 1/468 |
| 2006/0144644 | A1 | 7/2006 | Chiba | |
| 2007/0151809 | A1 | 7/2007 | Tyni et al. | |
| 2008/0128216 | A1 | 6/2008 | Nakamura | |
| 2012/0037461 | A1 | 2/2012 | Finschi | |
| 2012/0252498 | A1 | 10/2012 | Trinchero et al. | |
| 2012/0279808 | A1 | 11/2012 | Terry | |
| 2012/0318617 | A1 | 12/2012 | Sarjanen et al. | |

FOREIGN PATENT DOCUMENTS

| | | | |
|---|---|---|---|
| JP | 2005280906 | A | 10/2005 |
| JP | 2006232412 | A | 9/2006 |
| JP | 2007302364 | A | 11/2007 |
| KR | 1020110126297 | A | 11/2011 |
| WO | 2006000618 | A2 | 1/2006 |
| WO | 2007101720 | A2 | 9/2007 |

OTHER PUBLICATIONS

Japanese Office Action for JP2016536622, dated May 16, 2017, 5 pages.

Alessandro Carlotto, "Proximity Classification for Mobile Devices Using Wi-Fi Envrionment Similarity", MELT '08 Proceedings of the First ACM Intl Workshop on Mobile Entity Localization and Tracking in GPS-less Environments, accessed Nov. 17, 2013, 2 pages.

BlipSystems.com, "BlipTrack Tracking—Privacy Concerns", downloaded from http://www.blipsystems.com/urban/privacy-concerns/ on Nov. 7, 2013, 1 page.

BlueMotion/Blooth FAQ, "InterVistas BlueMotion/Blooth, Bluetooth Monitoring for Airports", Dec. 1, 2010, downloaded from http://www.intervistas.com/downloads/BlueMotion_FAQ_08Feb2011.pdf on Nov. 7, 2013, 3 pages.

International Search Report and Written Opinion for application PCT/US2013/073586, dated Sep. 4, 2014, 12 pages.

Melanie D.G. Kaplan, "Intelligent Elevators Answer Vertical Challenges", SmartPlanet.com, Jul. 17, 2012, 5 pages.

Stackoverflow.com, "Detecting Proximity Using MAC Address", downloaded from http://stackoverflow.com/questions/19641454/detecting-proximity-using-mac-address on Nov. 7, 2013, 2 pages.

Superuser.com, "Wi-Fi Client Mac Address Scanning", downloaded from http://superuser.com/questions/471450/wi-fi-client-mac-address-scanning on Nov. 7, 2013, 1 page.

Japanese Office Action for application JP 2016-536622, dated Nov. 7, 2017, 5 pages.

* cited by examiner

SERVICE REQUEST USING WIRELESS PROGRAMMABLE DEVICE

BACKGROUND

Conventionally, an elevator system recognizes the existence of individual users planning to use the elevator in order to respond to demand or requests for service. Buttons, keypad devices, and touchscreen devices may be used for entering a request for elevator service. For example, an elevator system may utilize a two-button (e.g., up or down button) configuration, wherein a direction of travel within the elevator system is requested. An elevator system may utilize a keypad and/or touchscreen device with destination dispatching, such that the user may specify a floor or landing that the user would like to be taken to as part of the request for service. In either case/configuration, a user/passenger engages in an affirmative action to request elevator service by using devices available at the building or facility where the elevator system is located.

BRIEF SUMMARY

An embodiment is directed to a method comprising: receiving, by a computing device comprising a processor, a request for at least one service associated with an elevator system from a mobile device over a cellular network, validating the request based on a determined location of the mobile device, and causing at least one resource associated with the at least one service to be scheduled based on the validating indicating that the request is approved.

An embodiment is directed to an apparatus comprising: at least one processor, and memory having instructions stored thereon that, when executed by the at least one processor, cause the apparatus to: receive a request for at least one service associated with an elevator system from a mobile device over a cellular network, validate the request based on a determined location of the mobile device, and cause at least one resource associated with the at least one service to be scheduled based on the validating indicating that the request is approved.

An embodiment is directed to a conveyance system comprising: at least one controller configured to schedule resources of the conveyance system, and a server configured to: receive a request for at least one service associated with the conveyance system from a mobile device over a cellular network, validate the request based on a determined location of the mobile device, and based upon approving the request, transmit the request to the at least one controller.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
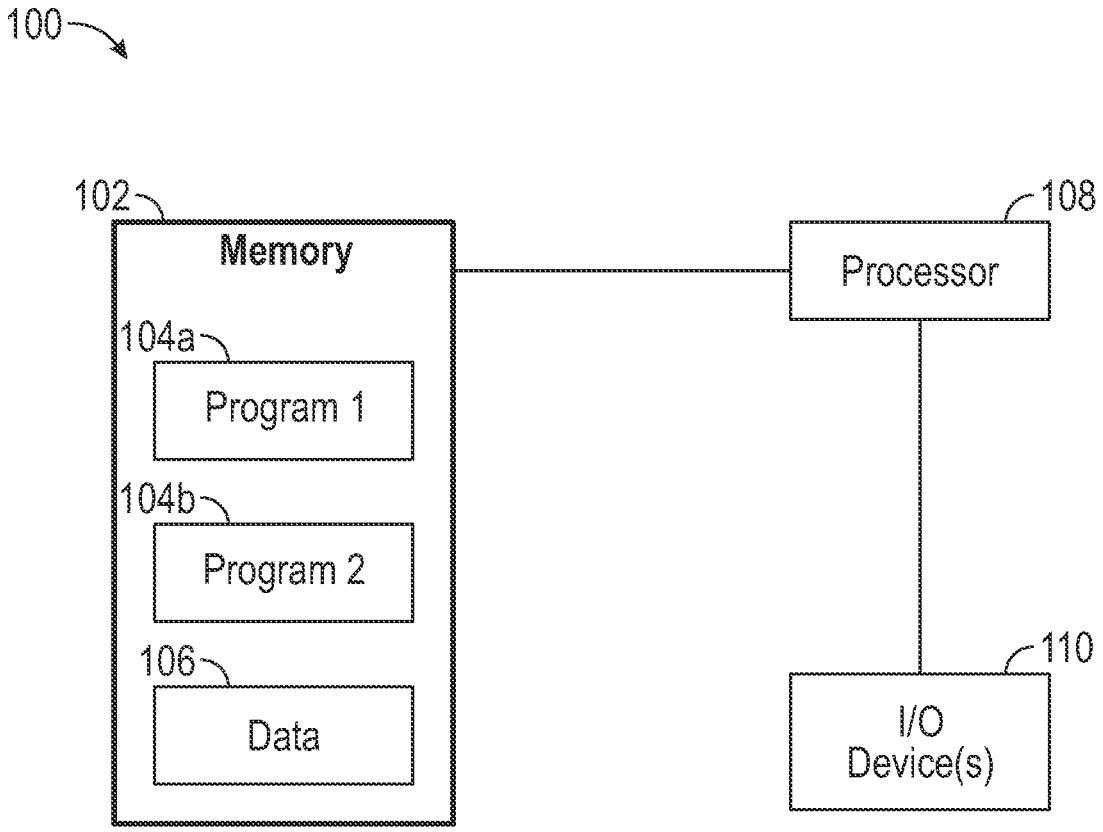
FIG. 1 is a schematic block diagram illustrating an exemplary computing system.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this respect, a coupling between entities may refer to either a direct or an indirect connection.

Exemplary embodiments of apparatuses, systems, and methods are described for fulfilling a request for service, such as a request for elevator service. In some embodiments, a request for elevator service may be communicated over one or more lines, connections, or networks, such as one or more cellular networks. The request for service may be initiated by a mobile device associated with a user, in a passive or active manner. In some embodiments, the mobile device may be operative in conjunction with the Transmission Control Protocol (TCP) and/or the User Datagram Protocol (UDP). In some embodiments, a request for service may be authenticated or validated based on a location of the mobile device. In some embodiments, a request for service may be fulfilled in accordance with one or more profiles, such as one or more user or mobile device profiles. In some embodiments the profiles may be registered as part of a registration process. In some embodiments, an elevator system may be registered with a service provider.

Referring to FIG. 1, an exemplary computing system 100 is shown. The system 100 is shown as including a memory 102. The memory 102 may store executable instructions. The executable instructions may be stored or organized in any manner and at any level of abstraction, such as in connection with one or more applications, processes, routines, procedures, methods, etc. As an example, at least a portion of the instructions are shown in FIG. 1 as being associated with a first program 104*a* and a second program 104*b*.

The memory 102 may store data 106. The data 106 may include profile or registration data, elevator car data, a device identifier, or any other type of data.

The instructions stored in the memory 102 may be executed by one or more processors, such as a processor 108. The processor 108 may be operative on the data 106.

The processor 108 may be coupled to one or more input/output (I/O) devices 110. In some embodiments, the I/O device(s) 110 may include one or more of a keyboard or keypad, a touchscreen or touch panel, a display screen, a microphone, a speaker, a mouse, a button, a remote control, a joystick, a printer, a telephone or mobile device (e.g., a smartphone), a sensor, etc. The I/O device(s) 110 may be configured to provide an interface to allow a user to interact with the system 100. For example, the I/O device(s) may support a graphical user interface (GUI) and/or voice-to-text capabilities.

Figure 2:
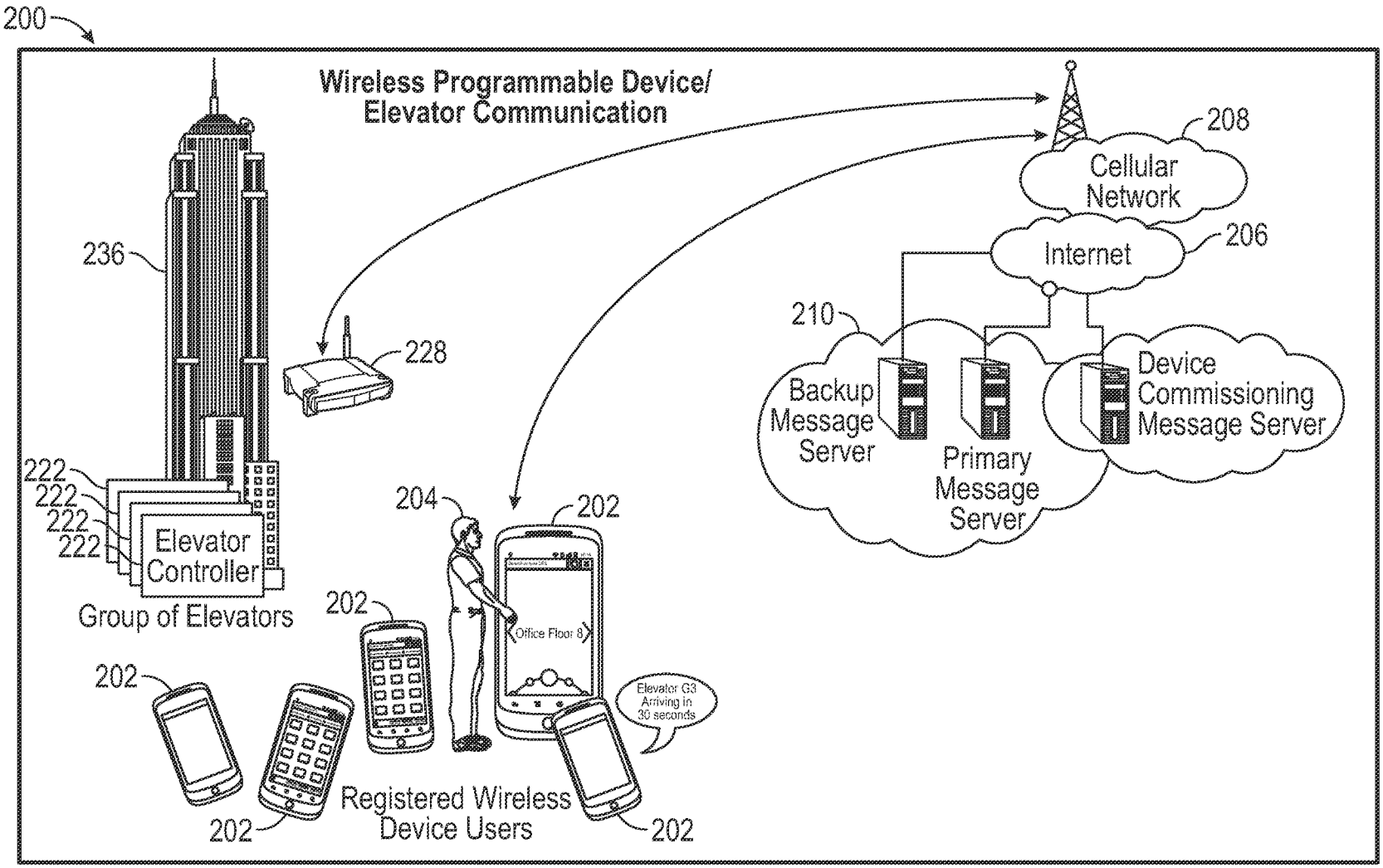
FIG. 2 illustrates a block diagram of an exemplary elevator system.

Turning now to FIG. 2, an exemplary system 200 in accordance with one or more embodiments is shown. The system 200 may be implemented in connection with one or more components, devices, or other systems (e.g., system 100). The system 200 may be associated with an elevator system. The system 200 may be used to process or fulfill requests for elevator service.

The system 200 may include one or more mobile devices 202, such as a phone, a laptop, a tablet, etc. One or more of the mobile devices 202 may be associated with (e.g., owned by) a particular user 204. The user 204 may use his/her mobile device(s) 202 to request a service, such as an elevator service.

The user 204/mobile device 202 may request service in an affirmative or active manner. For example, the user 204 may enter an explicit request for elevator service using an I/O interface (e.g., I/O devices 110) of the mobile device 202.

The user 204/mobile device 202 may request service in a passive manner. For example, a profile may be established for the user 204 or the mobile device 202, optionally as part of a registration process with, e.g., a service provider. The profile may contain a log of the user 204's history or activities, such as where the user 204 has gone or traveled to, the user 204's preferences, or any other data that may be applicable to the user 204 (subject to any privacy restrictions that the user 204 may impose or privacy restrictions enforced by law, code, or regulation). The profile may be accessed or analyzed to determine the likelihood or probability that the user 204 will request service (e.g., elevator service) at a particular moment in time (e.g., a particular day or time of day). Resources may be provisioned or allocated to fulfill the request (e.g., an elevator car call may be placed) in the event that the probability of requested service, or consumption or use of a resource associated with the service, is greater than a threshold.

The request for service may be conveyed or transmitted from the mobile device 202 to one or more networks. For example, the request for service may be transmitted to the Internet 206 and/or a cellular network 208. The network(s) may include infrastructure that may be organized to facilitate cloud computing. For example, a cloud 210 may include one or more servers, such as a primary message server, a backup message server, and a device commissioning message server.

In some embodiments, the request for service may specify a type of service requested, at any level of detail or abstraction. For example, a first request for service may specify that elevator service is requested, a second request for service may specify one or more of a departure floor or landing and/or a destination floor or landing, and a third request for service may specify that elevator service is desired to accommodate a heavy load (e.g., freight or cargo) with a number of other users or passengers in an amount less than a threshold. In some embodiments, the request for service transmitted from the mobile device 202 may include an identifier associated with the user 204 or the mobile device 203 in order to allow, e.g., the servers 210 to distinguish between users 204 or devices 202.

The servers may be configured to process requests for service received from mobile devices 202. As part of the processing, the servers may validate or authenticate a mobile device 202 and/or a user 204, potentially based on an identifier associated with the user 204 or the mobile device 202. The validation may be based on a location of the user 204 or the mobile device 202. The location may be determined based on one or more location-based services or techniques, such as triangulation, global positioning system (GPS), etc. In some embodiments, the user may need to be within a threshold distance of a location (e.g., a building) where the requested service (e.g., elevator service) is provided in order for the service request to be approved. Such validation or conditional-approval may be used to minimize nuisance calls to the location or prevent intentional service-attacks (e.g., hacking). A profile for a user 204 or mobile device 202 may maintain a log or count of the number of times a service request for the user 204/device 202 has been approved and/or a count of the number of times a service request for the user 204/device 202 has been disapproved. If the number of disapprovals (or the ratio of disapprovals to approvals) exceeds a threshold, future requests for service from the user 204/device 202 may be denied in order to help minimize abusive practices/requests.

If a service request is validated or approved by, e.g., the servers 210, the service request may be transmitted from the servers 210 to one or more controllers 222, such as one or more elevator controllers. The service request may be routed through a device 228, such as a gateway or modem. The device 228 may be configured to monitor for service requests. The device 228 may be coupled to the servers 210 and/or the networks 206, 208 via one or more mediums, such as a phone line, a cable, a fiber optic line, etc.

The controllers 222 may be configured to communicate with the computing device 228 and/or one another to fulfill service requests. In this respect, it should be noted that service requests might not only originate from servers 210 but may also originate locally (e.g., within a building 236 in which the controllers 222 may be located or in which the requested service(s) may be provided). The controllers 222 may select a resource (e.g., an elevator system or elevator car) that is suited to fulfill a service request, potentially based on one or more considerations, such as power consumption/efficiency, quality of service (e.g., reduction in waiting time until a user or passenger arrives at a destination floor or landing), etc. In some embodiments, the servers 210 may select the resource to fulfill a service request, and such a selection may be transmitted by the servers 210 to one or more of the controllers 222.

In some embodiments, one or more of the controllers 222 and/or the device 228 may be registered with, e.g., a service provider. The service provider may be responsible for accepting and processing (e.g., validating or approving/disapproving) service requests and routing (approved) service requests to an appropriate entity (e.g., one or more controllers 222).

The systems 100 and 200 are illustrative. In some embodiments, one or more of the entities may be optional. In some embodiments, additional entities not shown may be included. For example, in some embodiments the systems 100 and/or 200 may be associated with one or more networks, such as one or more computer or telephone networks. In some embodiments, the entities may be arranged or organized in a manner different from what is shown in FIGS. 1-2.

Figure 3:
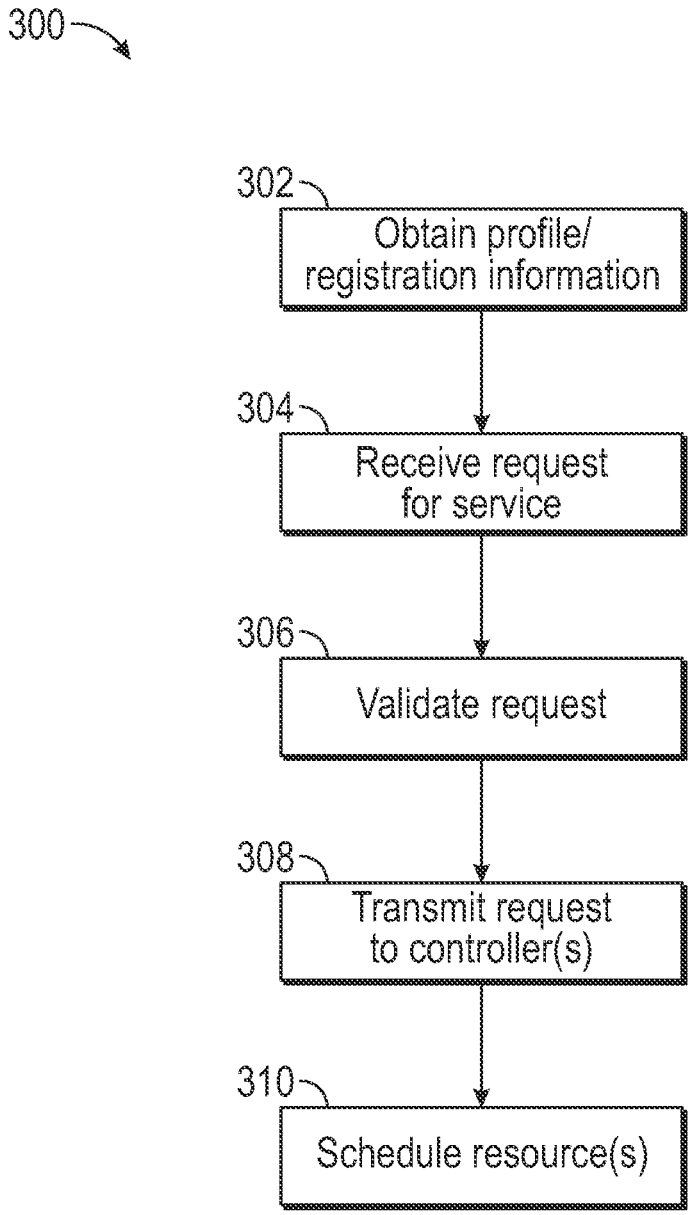
FIG. 3 illustrates a flow chart of an exemplary method.

Referring now to FIG. 3 a flowchart of a method 300 is shown that may be used in connection with one or more entities, devices or systems, such as those described herein. The method 300 may be used to fulfill a request for service, such as a request for service received from a mobile device over one or more networks.

In block 302, profile information may be obtained. The profile information may be obtained as part of a registration process. The profile information may include one or more of: an identifier associated with a mobile device, a nickname associated with the mobile device or a user of the mobile device, preferences associated with a user of the mobile device, patterns of usage of a service or system (e.g., an elevator system), etc. As part of block 302, a registration or profile may be received for the service or system itself.

In block 304, a request for service may be received.

In block 306, the request may be validated. As part of the validation, the request may be approved, partially approved, denied/rejected, or a counter-proposal may be transmitted to a requester or requesting device modifying one or more terms of the requested service. As part of block 306, a status message or the like may be transmitted to a mobile or user device advising of the status of the validation.

In block 308, approved (or partially approved) requests for service, potentially subject to processing, may be transmitted or forwarded to, e.g., one or more controllers.

In block 310, the controller(s) may schedule resource(s) to fulfill the service request of block 308. For example, in the context of an elevator system, an elevator bank or elevator car call may be made to summon an elevator car to a particular floor or landing to pick-up a user or passenger.

The method 300 is illustrative. In some embodiments, one or more of the blocks or operations (or portions thereof) may be optional. In some embodiments, additional operations not shown may be included. In some embodiments, the operations may execute in an order or sequence different from what is shown.

In some embodiments, a user of a mobile wireless programmable device may request a service within or outside of a building or facility.

In some embodiments, a flexible interface is provided to allow a user to request one or more services. The look-and-feel of the interface may be selected by the user. In some embodiments, the look-and-feel of the interface may be selected by a service provider or an owner or operator of the service being provided to the user. In this respect, the same service (e.g., elevator service) provided by first and second operators (e.g., a hotel brand/chain and an airport authority, respectively) may be distinguishable to a user requesting service at first and second locations (e.g., a hotel and an airport, respectively).

In some embodiments, requests for service may be scheduled in advance of when needed. In this manner, service can be provided more efficiently (e.g., wait times for fulfilling service requests may be reduced or minimized).

In some embodiments, a request for service may be entered on a user device, such as a mobile device. Thus, a user might not be required to touch public devices located within a building or facility, thereby promoting health/hygiene.

In some embodiments, such as embodiments where a profile is maintained for a user or a user device, customized or tailored services may be provided. For example, a very important person (VIP) may receive upgraded services, such as his/her own elevator car to travel to a destination floor or landing of his/her choosing.

As described above, UDP and/or TCP protocols may be used. Such protocols may provide a low overhead cost of operation of a mobile device connecting to an elevator group. More generally, aspects of the disclosure may be implemented in connection with existing infrastructure, thereby reducing cost and allowing for efficient installation into new or existing facilities or buildings. This allows for the opportunity for service upgrades or enhancements to accommodate wireless device-based services.

In some embodiments, one or more fees may be charged to enable or provide a particular service. In some embodiments, services may be provided for specified durations or times. If a user wishes to use a service beyond the specified duration/time, the user may be required to pay a fee for such extended service opportunities.

In some embodiments, protocols or communication pathways may be used to convey or transfer data or information of any type. Such data/information may include files, videos, pictures, Voice over Internet Protocol (VoIP) data, etc.

In some embodiments, services may be targeted to elevator maintenance and facility staff, e.g., security, cleaning, management, etc.

Aspects of the disclosure may be used in connection with one or more data mining applications. For example, patterns of elevator usage may be analyzed to suggest alternative times that users could consume elevator resources. Advertising opportunities may be available. For example, if a user profile indicates that the user likes to drink coffee, coupons for free coffee may be provided to the user as an incentive to utilize the elevator during off-peak times or periods.

While some of the examples described herein related to elevator systems, aspects of this disclosure may be applied in connection with other types of conveyance devices and systems, such as a dumbwaiter, an escalator, a moving sidewalk, a wheelchair lift, etc.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer program products or computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A method comprising:

receiving, by a computing device comprising a processor, a request for at least one service associated with an elevator system from a mobile device over a cellular network;

validating the request based on a determined location of the mobile device; and causing at least one resource associated with the at least one service to be scheduled based on the validating indicating that the request is approved, wherein the scheduling of the at least one resource is initiated by a placement of an elevator car call.

2. The method of claim 1, wherein the computing device comprises a server, the method further comprising:

transmitting, by the server, the request to at least one controller associated with the elevator system and coupled to the server, wherein the controller is configured to schedule the at least one resource.

3. The method of claim 2, wherein the at least one controller is coupled to at least one of a modem and a gateway, and wherein the at least one of the modem and the gateway is coupled to the server, the method further comprising:

transmitting, by the server, the request to the at least one controller via the at least one of a modem and a gateway.

4. The method of claim 1, wherein the location of the mobile device is determined based on at least one of a triangulation technique and a global positioning system (GPS) technique.

5. The method of claim 1, wherein the request for service is entered as an explicit request via an input/output (I/O) interface of the mobile device.

6. The method of claim 1, wherein the request for service is entered in a passive manner, and wherein the validation of the request comprises a determination that a probability that the at least one resource will be used is greater than a threshold.

7. The method of claim 1, wherein the request is received in accordance with at least one of the Transmission Control Protocol (TCP) and the User Datagram Protocol (UDP).

8. The method of claim 1, wherein the validation of the request is based on a registration of a service provider associated with the at least one service.

9. The method of claim 1, wherein the at least one resource is selected based on a profile associated with at least one of the mobile device and a user associated with the mobile device.

10. An apparatus comprising:

at least one processor; and memory having instructions stored thereon that, when executed by the at least one processor, cause the apparatus to:

receive a request for at least one service associated with an elevator system from a mobile device over a cellular network;

validate the request based on a determined location of the mobile device; and cause at least one resource associated with the at least one service to be scheduled based on the validating indicating that the request is approved, wherein the scheduling of the at least one resource is initiated by a placement of an elevator car call.

11. The apparatus of claim 10, wherein the location of the mobile device is determined based on at least one of a triangulation technique and a global positioning system (GPS) technique.

12. The apparatus of claim 10, wherein the request is received by the apparatus in accordance with at least one of the Transmission Control Protocol (TCP) and the User Datagram Protocol (UDP).

13. The apparatus of claim 10, wherein the instructions, when executed by the at least one processor, cause the apparatus to:

cause the at least one resource to be scheduled based on a determination that a fee has been paid for the at least one service.

14. The apparatus of claim 10, wherein the request comprises an identification of at least one of the mobile device and a user associated with the mobile device, and wherein the apparatus is configured to validate the request based on the identification.

15. A conveyance system comprising:

at least one controller configured to schedule resources of the conveyance system; and a server configured to:

receive a request for at least one service associated with the conveyance system from a mobile device over a cellular network, validate the request based on a determined location of the mobile device, and based upon validating the request, transmit the request to the at least one controller, wherein the request is initiated by a placement of an elevator car call.

* * * * *